United States Patent [19]

Büdenbender

[11] Patent Number: 4,905,858

[45] Date of Patent: Mar. 6, 1990

[54] SHEETMETAL CONTAINER WITH ATTACHED END CLOSURES

[76] Inventor: Bernd Büdenbender, Schubertweg 5, 2160 Stade, Fed. Rep. of Germany

[21] Appl. No.: 237,904

[22] Filed: Aug. 29, 1988

[30] Foreign Application Priority Data

| | | | |
|---|---|---|---|
| Aug. 28, 1987 | [DE] | Fed. Rep. of Germany | 8711650 |
| Sep. 4, 1987 | [DE] | Fed. Rep. of Germany | 8711969 |
| Apr. 21, 1988 | [DE] | Fed. Rep. of Germany | 3813433 |

[51] Int. Cl.[4] ..... B65D 6/34

[52] U.S. Cl. ..... 220/67; 220/76; 220/79

[58] Field of Search ..... 220/67, 68, 75, 76, 220/79

[56] References Cited

FOREIGN PATENT DOCUMENTS

| | | |
|---|---|---|
| 733200 | 3/1943 | Fed. Rep. of Germany . |
| 3546458 | 10/1986 | Fed. Rep. of Germany . |
| 3600532 | 10/1986 | Fed. Rep. of Germany . |
| 3706581 | 7/1988 | Fed. Rep. of Germany . |

*Primary Examiner*—Man-Fu Moy

*Attorney, Agent, or Firm*—Herbert Dubno

[57] ABSTRACT

A container especially a drum, composed of sheetmetal has its end closures formed with cup-shaped depressions which are fitted snugly into the cylindrical ends of the drum body. A weld seam at an intermediate portion of the height of the wall of the depression seals each closure to the drum body, a flange of the wall abuts an end edge of the drum body and each end is additionally reinforced by an inwardly rolled rim on the flange of the closure. The ends of the body are not rolled or bent.

18 Claims, 4 Drawing Sheets

SHEETMETAL CONTAINER WITH ATTACHED END CLOSURES

FIELD OF THE INVENTION

My present invention relates to a container made from sheetmetal and, more particularly, to a barrel or drum made from sheetmetal and having a generally cylindrical body to which a pair of end closures are attached. These end closures form a cover and a bottom to the cylindrical body which is formed with open ends.

BACKGROUND OF THE INVENTION

Barrels, drums and the like of sheetmetal with end closures of the type described have been provided heretofore by rolling, welding, soldering or brazing the sheetmetal cover or bottom to the rim of the sheetmetal generally cylindrical body.

It is known in connection with thin sheet metals and the fabrication of food preservative cans, for example, to attach the bottom or cover by a folding operation (see German Patent No. 733 200) in which a folding operation which also is supported by a resistance welding of interfitting parts is used to seal the cover or bottom to the cylindrical body. A stiffening bend is provided for the edges in this arrangement.

It is also known to weld prefolded or partly prefolded cover or bottom arrangements to a body of a container from German Open Application No. DE-OS 35 46 458, thereby eliminating the need for sealing masses to ensure an effective seal at the cover or bottom. In this case, however, three interfitting sheetmetal layers are joined together by the weld seam which is preferably made by a laser beam.

German Open Application No. DE-OS 36 00 532 describes the formation of containers in which the bottom and the container body are welded together without interfolding or with a minimum of folding and without speed sealing means other than the folding and welding.

In the past it has been a problem to provide by the techniques described, large stable containers especially barrels or drums in a simple and economical manner and in such fashion as to enable the various steps in the process of making the container to be separated or performed at different locations.

OBJECTS OF THE INVENTION

It is the principal object of the present invention to provide an improved container, especially a drum or barrel, which will be free from the drawbacks previously described and especially, can be fabricated in a simple and economical manner.

It is another object of my invention to provide an improved method of making a barrel or drum.

It is also an object of the invention to provide an improved sheetmetal drum or barrel and a method of making same, whereby large and stable containers can be fabricated easily, simply and without the problems which have characterized earlier methods, and at minimum cost, while affording the possibility of separating the manufacturing operation into various stages which can be performed at different locations.

SUMMARY OF THE INVENTION

These objects and others which will become apparent hereinafter are attained, in accordance with the invention, with a sheetmetal container, especially a barrel or drum having a preferably cylindrical body whose open ends are closed respectively by cover members forming a bottom and a top to the drum.

According to the invention, the top or bottom of the drum is formed with a cup-shaped depressed portion of limited height whose outer diameter corresponds to the inner diameter of the body, while the wall of this depression is provided with a flange which rests upon an end of the body and is rolled over and inwardly along the exterior of the body. A weld seam is provided between this wall and the body at a location corresponding to the partial height of this wall and preferably the weld seam is a slightly overlapping continuous peripheral weld seam. The reference to "overlap" here means that the weld upon its formation may have overlapping portions so that the width of the weld can be twice or more times the width of the weld seam or the like forming the weld.

More specifically, the container of the invention can have respective closure members closing the ends of the body with at least one of the container members comprising:

- a tubular sheetmetal container body having oppositely open ends, and respective closure members closing the ends, at least one of the members comprising:
- a disk of sheetmetal formed with a cup-shaped inwardly extending depressed portion delimited by a generally cylindrical wall adjoining an annular flange, the depressed portion fitting into a respective end of the body, the flange abutting an edge of the respective end;
- a continuous weld seam sealing the one of the members to the body all around the circumference of the body and being formed between the body and the one of the members at an intermediate location along the height of the wall; and
- an inwardly rolled rim on the flange disposed along the exterior of the body and embracing the edge.

The method of making the container can comprise the steps of:

- forming a tubular sheetmetal container body having oppositely open ends, and respective closure members for closing the ends, the members each comprising a disk of sheetmetal formed with a cup-shaped inwardly extending depressed portion delimited by a generally cylindrical wall adjoining an annular flange;
- fitting each of the tubular members into a respective one of the ends of the body so that the respective depressed portion is received in the body, the respective wall lies along an inner surface of the body and the respective flange abuts an edge of the respective end;
- bracing each of the walls radially against the body and forming a respective continuous weld seam between each of the walls and the body at an intermediate location over the height of the respective wall; and
- rolling inwardly a rim of each of the closure members adjoining the respective flange to embrace the respective edge.

The invention can make use of a drum body which is rolled and welded to a tubular structure which is open at its ends and closed by the cover members. However, since the cover members are immediately rolled and abut with the aforementioned flanges, the circular ends of the container body, which do not have to be rolled or bent outwardly, while nevertheless affording the reinforcement which results from the rolled rim of the cover-member flanges, a stiff stable drum structure is obtained which enables the drum to be easily handled and transported. The need for rolling the ends of the drum body itself is eliminated and thus fabrication is greatly simplified.

The cover and bottom can be simply stamped as rounds from sheetmetal strip, especially steel strip and can easily seep down, pressed or otherwise formed with the cylindrical depression or embossment in a process without removal of material from the round or blank, i.e. without machining. Preferably, the blank is stamped to form the cup-shaped depression.

It is also possible in accordance with the invention, to form the depression in the sheet metal strip and then stamp out the round or blank concentric with the circular depression.

In either case, because of the presence of the circular depression, the top or bottom closure members can be easily inserted centrally in the respective ends of the container body and sealed with respect to the container body by the welding operation.

The depth of insertion is set automatically because the edge of the body comes to rest against the flange.

The finished barrel or drum has been found to be unusually stable since the wall of the depression in the cover lining and abutting the wall of the body adjacent its end edge additionally stabilizes the body and the ends of the drum are additionally stiffened by the inward rolling of the edge of the flange.

The connection weld seam is located inwardly from the abutting edge of the body to a sufficient extent that forces acting on this edge or in the region of the edge are not likely to deform thee region of the weld seam.

The formation of the weld seam is promoted and the strength of this seam increased by ensuring at least in the region of the weld seam, that the inner surface of the body of the drum will bear forcibly and tightly against the outer surface of the depression.

This can be ensured by providing, in accordance with the invention, an outwardly projecting bulge on the outer surface of the depression which can engage in an annular trough of the body or may simply bear against a cylindrical surface thereof.

Similarly, an inwardly deformed bulge on the body may bear upon the outer wall of the depression in the closure member or can engage in a trough formed in the latter.

A firm contact between the two can also be ensured by applying a prestress either inwardly to the drum body or outwardly to the closure member during welding. This prestress can either be in the elastic deformation range of the structure or in the plastic deformation range thereof.

According to the invention, therefore, the body can be formed circumferentially along the seam with an outwardly open trough defining an inwardly extending rib bearing upon the wall of the depression.

The depression can be formed with a generally planar floor with an outwardly bulging bead bearing on an inner surface of the body and defining a maximum diameter of the wall.

The depression can have a generally planar floor adjoining the wall and the diameter which is reduced progressively in the axial direction from the floor to the flange. This progressive reduction in diameter can be a stepwise reduction or a continuous reduction.

Advantageously, the depression is formed with a generally planar floor connected to the wall by a collar formed by an 180° inward bend and the plane of the floor is located intermediate the height of the wall. The collar can be formed by a U-section bend or by an inwardly embossed groove in the floor forming a bulge lying inwardly in the container of the plane of the floor.

The wall can be formed with a constriction extending inwardly from the body adjacent the flange and the wall and body can be formed with aligned bores axially outwardly of the weld seam and serving to drain rain water from the concave top of the barrel or drum when it is upright. The weld seam can be a protective gas or laser weld seam.

BRIEF DESCRIPTION OF THE DRAWING

The above objects, features and advantages of my invention will become more readily apparent from the following description, reference being made to the accompanying drawing in which.

SPECIFIC DESCRIPTION

Figure 1:
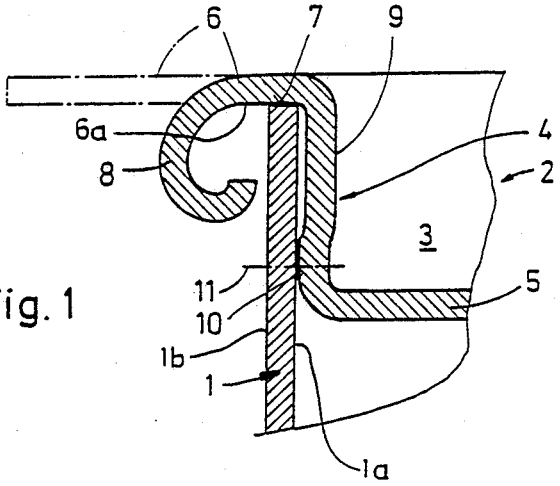
FIG. 1 is a cross-sectional view of a portion of a drum fabricated in accordance with the principles of this invention.

All of the FIGURES of the drawing show only the junction between a closure member and the generally cylindrical body of a drum or barrel made of sheetmetal. It will be understood that the closure member is circular in form and the edge of the drum body against which the closure member bears is likewise circular in form. The axis of the drum body is considered to lie in the plane of the paper in all FIGURES and the view illustrated corresponds to a section along an axial plane of the body. Furthermore, while the closure member has been shown as a top cover for the upper end of the barrel or drum, it will be understood that the bottom closure member can have an identical construction.

As noted, FIG. 1 shows only a fragment of one end of a drum body 1 and a cover 2 which closes one of the two open ends of this generally cylindrical body.

The cover 2 is centrally provided with a depression 3, so dimensioned that its approximately cylindrical wall 4, at least in the region of a bulge 10 thereon bears forcibly on the inner surface 1*a* of the cylindrical body 1.

The cover 2 is force-fitted into the body 1 until its bottom or floor 5 lies inwardly of the circular edge 7 bordering the end of the body. The cover 2 has an outwardly extending flange 6 therein in a plane parallel to the floor 5 and perpendicular to the axis of the drum.

The cover 2 is driven into the drum until the inner surface 6*a* of the flange 6 comes to lay or abut against the edge 7.

The outer rim of the flange 6 is rolled downwardly and inwardly to form the rolled rim 8. Approximately in the shadow of the bead 10, i.e. within the axial region of this bead, I provide a weld seam 11 between the body 1 and the cover 2 circumferentially all around the container. The weld seam 11 can be formed by a laser beam and can be generated from the exterior of the body 1, from within the cover 2 and the depression 3, or both. The construction thus described is characterized by a high stability of the drum, simplicity and low cost. Sealing can be effected exclusively by the preferably slightly overlapped weld seam since that eliminates the need for sealing masses which have hitherto been considered essential in many types of drum constructions.

The fitting of the bottom or cover into the body is simple since there is no need for precision because the flange 6 limits the degree of insertion and supports the cover against the edge 7 so that impact applied to the cover is transmitted in compression to this edge.

The method of assembly according to the invention allows subdivision into the various stages so that it is not necessary to provide a long fabrication line.

Figure 2:
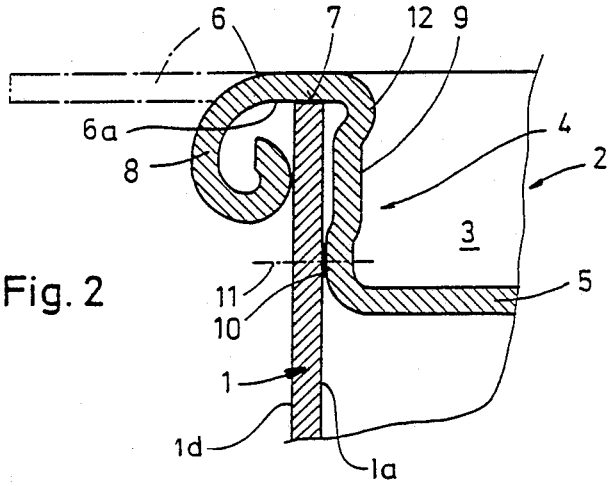
FIG. 2 is a view similar to FIG. 1 of a further embodiment illustrating an inward constriction in the wall of the depression.

For example, in a first stage, the body, cover or bottom may have the flange fully extended as shown in dot-dash lines in FIGS. 1 and 2. At a later stage, e.g. after the cover or bottom have been applied, this extended flange can be rolled inwardly to form the rim 8.

Alternatively, the rim can be preformed on the cover or bottom before the latter is forced into the body 1.

The inwardly rolled rim 8 may be rolled through about 270° (see FIG. 1) while maintaining a slight distance of this rim from the outer surface 1*b* of the body 1. However, it is also possible to roll the rim through approximately 360° (see FIG. 2) and to so form the rim that it lies approximately against the surface 1*d* as is also apparent from this FIGURE.

In this latter case, the rim 8 elastically bears inwardly against the body 1.

The inwardly rolled rim not only prevents injury, but ensures a greater stabilization of the barrel or drum.

The advantage of providing the cover or bottom with the inwardly rolled rim prior to assembly of the closure member onto the body is that the rolling operation can be carried out at the time of fabrication of the cover and not after the cover has been applied to the body.

In any case, fabrication of the drum can be subdivided so that in a first station the cover and bottom are formed and initially only the blank of the body is produced. In further stations, the body blank is rolled and welded along a generatrix thereof and only then are the cover and bottom closure members inserted and welded. When, of course, the flange has not previously been rolled inwardly, the inward rolling stp is then performed.

The invention also permits cover and body blanks to be stored and supplied to locations at which the barrels or drums will be assembled so that assembly can be effected at locations at which filling is to occur, for example. The invention makes it possible for prefabricated blanks for the covers, bottoms and body to be made in a centralized fashion with the assembly steps being carried out in a decentralized manner so that it is not necessary to ship voluminous prefabricated containers over long distances. The blanks can be packed rather compactly and shipped to locations where they are assembled. The blanks can be transported by containers, if desired.

In FIG. 1, the intimate mechanical contact in the region of the weld seam 11 between the cover 2 and the body 1 is effected by the outward bulge or bead, the remaining wall defining the minimum diameter portion 9 of the depression. In FIG. 1 the setback of the portion 9 from the inner wall 1*a* has been exaggerated and shown to extend the balance of the height of the wall.

However, in this construction, the bend at which the flange 6 adjoins the wall 4 of the depression can interfere with a proper engagement of the edge 7 against the flange.

Accordingly, it has been found to be advantageous to provide at the upper end of the region 9 an inward constriction 12 which defines the smallest diameter of the closure member and removes the bend connecting the flange 6 with the wall 4 even further from the inner surface 1*a* and thus from the edge 7.

This ensures that the edge 7 will abut a perfectly planar portion of the surface 6*a* of the flange. In addition, this ensures an increased strength for this end of the drum. Indeed, tests have shown that the constriction of FIG. 2 allows the end of the drum to withstand greater impact or shock, e.g. in free fall without damage.

Figure 3:
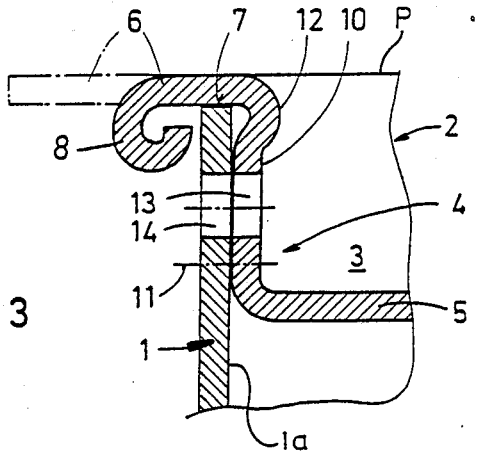
FIG. 3 is another view similar to FIG. 1 showing the holes for draining rain water from the depression.

FIG. 3 shows an embodiment of the invention in which the constriction 12 is provided as in FIG. 2 but the bulge 10 is not provided as a separate formation on the wall 4 but rather extends the full height of the latter to a constriction 12 from the floor 5. This ensures a flat lie of the wall 4 against the inner surface 1*a* of the body 1 not only in the region of the weld seam 11 but also in the region above this weld seam at which a pair of bores 13, 14 of the cover 2 and the body 1 are radially aligned. An appropriate clamping device may be applied within the depression 3 to press the region 10 outwardly into forced engagement with the body 1.

The deformation of the cover 2 may thus be within its elastic range or may be a plastic deformation. The device provided for this purpose may have fluid operated cylinders or a cone arrangement in which the forces generated by a axially displaceable cone which, like the cylindrical arrangement, can drive radial clamping shoes outwardly.

The bores 13, 14 may represent a plurality of pairs of bores for each cover, designed to allow rain water which might otherwise accumulate in the depression 3 to drain away.

Since the bung of bung drums and barrels should not be effected by stacking or handling, generally the bung will be provided below the end plane P of the barrel in the floor 5. Rain water can accumulate in the depression 3 in the event that bores 13 and 14 are not provided and make it difficult have access to the bung or may contaminate the bung and even permit water to leak past the bung as it is opened. With the bores 13 and 14, of course, which can be drilled or stamped, the collection of the rain water, spray water or the like above the floor 5 of the depression 3 is limited.

Figure 4:
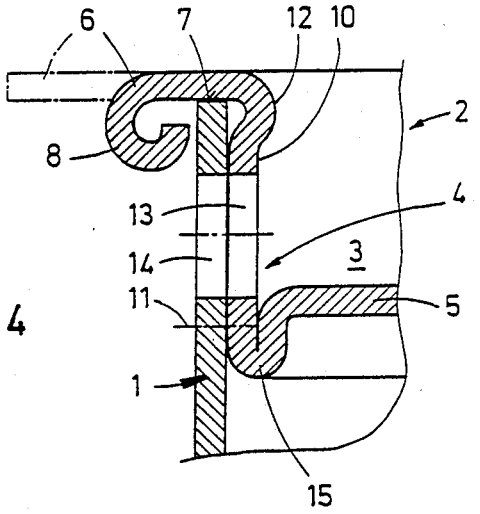
FIG. 4 is a view similar to FIG. 3 of another embodiment.

FIG. 4 shows an embodiment generally similar to that of FIG. 3 wherein the wall 4 is somewhat longer than that of FIG. 3 and merges via a U-shaped bend or collar 15 with the floor 5. This fold 15 allows the floor 5 to be raised with respect to the seam 11 substantially to the level of the bores 13 and 14 thereby reducing the accumulation of rain water in the depression 3. In addition, a more elastic connection is provided between the floor 5 and the wall 4 so that tensile forces on the weld seam by impact on the barrel are relieved. Consequently, the weld seam 11 need merely withstand shear stresses.

Figure 5:
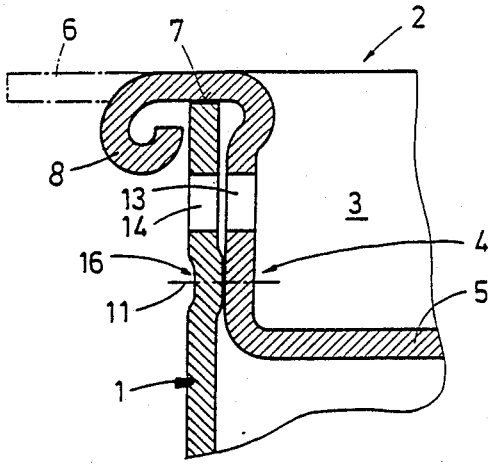
FIG. 5 is a fragmentary cross-sectional view through a portion of a bulge in the cylindrical drum body in the region of the weld.

To simplify and facilitate the welding of the cover to the body, I may make use of the configuration shown in FIG. 5 in which the weld seam 11 is effected along an annular trough 16 which forms an inner bulge bearing against the wall 4.

This bulge can, if desired, press against an outward bulge 10 of the type shown in FIGS. 1 and 2. The bulge 10 may also engage in a trough in the wall 1 or lie inwardly above or below the inward bulge formed by the trough 16.

The trough 16 and its inner bulge facilitate stressing of the cover against the body as previously described in an elastic deformation or plastic deformation.

Figure 6:
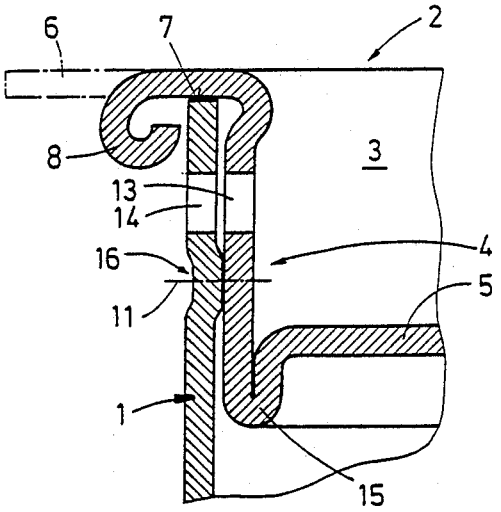
FIG. 6 is a view similar to FIG. 5 illustrating a U-shaped bend for increasing the flexibility of the junction between the generally cylindrical wall of the depression and the floor thereof.
Figure 7:
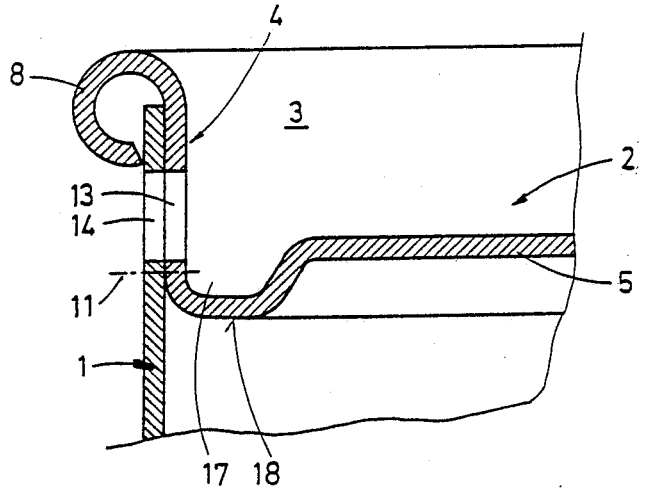
FIG. 7 is another fragmentary sectional view illustrating the attachment of the closure member to a generally cylindrical drum body or wall without requiring the bending or folding of the upper rim thereof but having a bead or corrugation to increase the flexibility between the depression, wall and the floor.

FIG. 6 illustrates an embodiment of the invention in which a collar 15 of the type previously described in connection with FIG. 4 is provided for a structure otherwise similar to that of FIG. 5.

If a sharp fold or bend of the type shown in FIGS. 4 and 6 is not desired, I may make use of the shallow bend 18 formed by the corrugation 17. The weld seam is here shown to lie below the floor 5 in the region of the corrugation 17 whose bulging portion 18 provides the function of the collar 15.

Preferably in this case, the weld seam 11 is applied after at least an deformation of the cover in the body 1.

Figure 8:
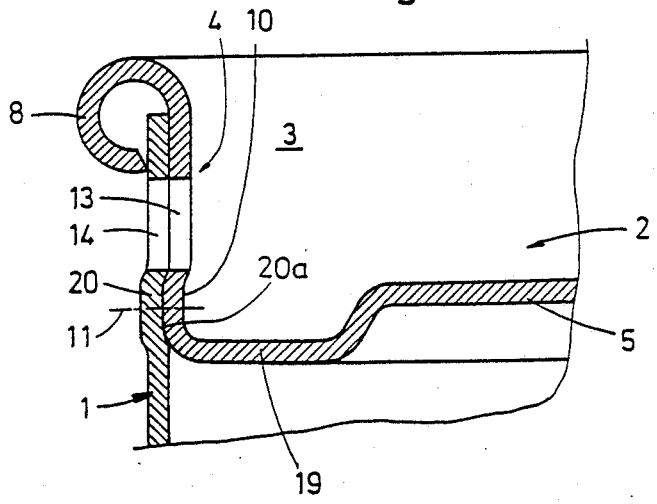
FIG. 8 is a view similar to FIG. 7 illustrating a variant on this construction.

The arrangement shown in FIG. 8 provides an even greater radius of curvature for the corrugation 19, allows the holes 13 and 14 to be located at the plane of the floor 5 and provides a bulge 10 which is enlarged in a trough 20*a* formed by the corrugation 20 in the body 1. The interfitting of the bulge 10 in the trough 20*a* allows the weld seam 11 to be more accurately located.

The corrugation 20 can have a depth which is less than the height of the bulge 10.

It will be apparent with the constructions described, that the invention not only solves the problem of providing an economical method of fabricating the drum or barrel and sealing the latter, but also affords a barrel of high stability by an approach which can allow the various parts of the barrel to be fabricated separately and assembled at finishing locations quite distant from those at which the blanks or parts of the barrel are made.

I claim:

1. A sheetmetal container, comprising:

a tubular sheetmetal container body having oppositely open ends defined by a single-thickness of the sheet metal; and respective closure members closing said oppositely open ends, at least one of said members comprising:

a disk of sheet metal formed with a cup-shaped inwardly extending depressed portion delimited by a generally cylindrical wall adjoining an annular flange, said depressed portion fitting into a respective one of said body, said flange protruding beyond the respective end of the body and abutting being juxtaposed with a free edge defined by the single thickness of said respective end, a continuous weld seam sealing said one of said members to said body all around the circumference of said body and being formed between said body and said one of said members at an intermediate location along the height of said wall, and a rim formed on said flange with continuously arcuate curve defining an inner edge reaching inwardly toward an outer surface of said body adjacent the respective free edge and inwardly rolled on said flange, said rim being disposed along the exterior of said body and embracing said free edge.

2. The sheetmetal container defined in claim 1 wherein said body is generally cylindrical, said body bears forcibly on said depression along said wall and said weld seam is a slightly overlapped weld seam.

3. The sheetmetal container defined in claim 1 wherein said body is formed circumferentially along said weld seam with an outwardly open trough defining an inwardly extending rib bearing upon said wall.

4. The sheetmetal container defined in claim 1 wherein said depression is formed with a generally planar floor adjoining said wall and said wall is provided adjacent said floor with an outwardly bulging bead bearing on an inner surface of said body and defining a maximum diameter of said wall.

5. The sheetmetal container defined in claim 1 wherein said depression is formed with a generally planar floor adjoining said wall and said wall has a diameter which is reduced progressively from said floor to said flange.

6. The sheetmetal container defined in claim 5 wherein said diameter is reduced stepwise from said floor to said flange.

7. The sheetmetal container defined in claim 5 wherein said diameter is reduced continuously from said floor to said flange.

8. The sheetmetal container defined in claim 1 wherein said depression is formed with a generally planar floor connected to said wall by a collar formed by a 180° inward bend and the plane of said floor is located intermediate the height of said wall.

9. The sheetmetal container defined in claim 8 wherein said collar is formed by a U-section bend.

10. The sheetmetal container defined in claim 8 wherein said collar is formed by an axially inwardly embossed groove in said floor forming a bulge lying inwardly in said container of the plane of said floor.

11. The sheetmetal container defined in claim 8 wherein said wall is formed with a constriction extending inwardly from said body adjacent said flange.

12. The sheetmetal container defined in claim 8 wherein said wall and said body are formed with aligned bores axially outwardly of said weld seam.

13. The sheetmetal container defined in claim 8 wherein said weld seam is a protective-gas weld seam.

14. The sheetmetal container defined in claim 8 wherein said weld seam is a laser weld seam.

15. The sheetmetal container defined in claim 8 wherein said wall and said body are braced against one another during the formation of said weld seam.

16. A method of making a sheet metal container, comprising the steps of:

forming a tubular sheetmetal container body having oppositely open ends defined by a single-thickness of the sheet metal, and respective closure members for closing said ends, said members each comprising a disk of sheet metal formed with a cup-shaped inwardly extending depressed portion delimited by a generally cylindrical wall adjoining an annular flange protruding beyond the respective end of the body;

fitting each of said tubular members into a respective one of said ends of said body with the respective flange extending over an edge of the respective end defined by said single-thickness so that the respective depressed portion is received in the body and the respective wall lies along an inner surface of the body;

bracing each of said walls radially against said body and forming a respective continuous weld seam between each of said walls and said body at an intermediate location over the height of the respective wall; and forming a continuously arcuate curve in said flange defining a rim having an inner edge terminating short of said free edge defined by said thickness by rolling inwardly the respective flange.

17. The method defined in claim 16 wherein each weld seam is formed by inert-gas welding.

18. The method defined in claim 16 wherein each weld seam is formed by laser welding.

* * * * *